United States Patent [19]

Inoue et al.

[11] 4,337,382

[45] Jun. 29, 1982

[54] MECHANISM FOR PREVENTING THE SIMULTANEOUS LOCKING OF PUSH BUTTONS IN A PUSH-BUTTON SWITCH DEVICE

[75] Inventors: Akihiko Inoue; Shigekata Sugiura, both of Soma, Japan

[73] Assignee: Alps Electric Co., Ltd., Tokyo, Japan

[21] Appl. No.: 184,292

[22] Filed: Sep. 5, 1980

[30] Foreign Application Priority Data

Sep. 8, 1979 [JP] Japan ..... 54-124339[U]

[51] Int. Cl.[3] ..... H01H 9/20

[52] U.S. Cl. ..... 200/5 E; 200/50 C; 200/328

[58] Field of Search ..... 200/1 R, 5 B, 5 C, 5 E, 200/5 EA, 5 EB, 50 C, 328; 74/483 PB

[56] References Cited

U.S. PATENT DOCUMENTS 3,706,863 12/1972 Britton et al. ..... 200/5 R 3,745,268 7/1973 Barker et al. ..... 200/5 E X 3,952,175 4/1976 Golbeck et al. .

3,970,806 7/1976 Distler .

*Primary Examiner*—James R. Scott

*Attorney, Agent, or Firm*—Guy W. Shoup; Gerard F. Dunne

[57] ABSTRACT

A locked-type push-button device which has a plurality of push buttons and only one of the push buttons can be locked in the depressed state when it is depressed. A mechanism includes a cam for preventing the simultaneous locking of two adjacent push buttons, which has nearly a semicircular shape in cross section. The cam has notches at positions corresponding to the positions of the push buttons, and the notches each have a width greater than the width of the respective push buttons. The notches are alternately arrayed on opposite sides of the cam, and is thus urged to turn in the opposite directions when it is depressed by the neighboring push buttons.

1 Claim, 5 Drawing Figures

MECHANISM FOR PREVENTING THE SIMULTANEOUS LOCKING OF PUSH BUTTONS IN A PUSH-BUTTON SWITCH DEVICE

BACKGROUND OF THE INVENTION

The present invention relates to a push button device equipped with a plurality of push buttons, and more specifically, to a mechanism for preventing the simultaneous locking of two adjacent push buttons.

Electric circuits often operate erroneously when two or more push buttons are inadvertently pushed at one time and when the thus simultaneously actuated push buttons are all locked. The locked-type push button device should thus be so constructed that all previously actuated buttons return to their initial state when another push button is actuated, and that two adjacent push buttons cannot be actuated simultaneously.

Lock-type push button devices have been proposed for use as the channel selector employed as a tuner for modern television sets since conventional channel selectors typically involved clumsy operation for selecting the channels, particularly when the channels are to be selected in the UHF band.

FIG. 1 is a diagram illustrating the appearance of a channel tuner employing the push buttons for selecting various channels, in which reference numeral 1 denotes a cabinet, 2 denotes a switch for selecting the appropriate band, and 3 denotes push buttons for selecting the channels. After the switch 2 for selecting the appropriate band has been set to a predetermined band, one of the push buttons 3 for selecting the channels is actuated to select a desired channel easily. With channel tuners of this type, however, the many number of channels in the VHF, UHF and, perhaps CATV band require increased number of push buttons arrayed with only a small distance between them. Therefore, unless they are actuated carefully, neighboring push buttons will often be depressed and become locked, and the desired channel would thus not often be selected properly.

With the locked-type push button device for use in channel tuners, therefore, the push buttons should not be locked but should return to the non-depressed position when two or more push buttons are simultaneously depressed to prevent erroneous operation or erroneous selection of a channel.

Conventional channel tuners employing push buttons have not typically been provided with structures preventing simultaneous locking of two push buttons. Devices for preventing the simultaneous locking of two adjacent switches used in other fields are complex in construction and their increased manufacturing costs make them prohibitive for use in channel tuners.

SUMMARY OF THE INVENTION

The object of this invention therefore is to provide a mechanism for preventing the simultaneous locking which is based primarily upon the push button arrangement, which is simple in construction and has an advantageous manufacturing cost, which is capable of reliably preventing the simultaneous locking of two adjacent switches, and which can be employed for channel tuners.

DESCRIPTION OF THE PREFERRED EMBODIMENT

An embodiment of the invention will now be explained below in conjunction with the accompanying drawings.

Figure 1:
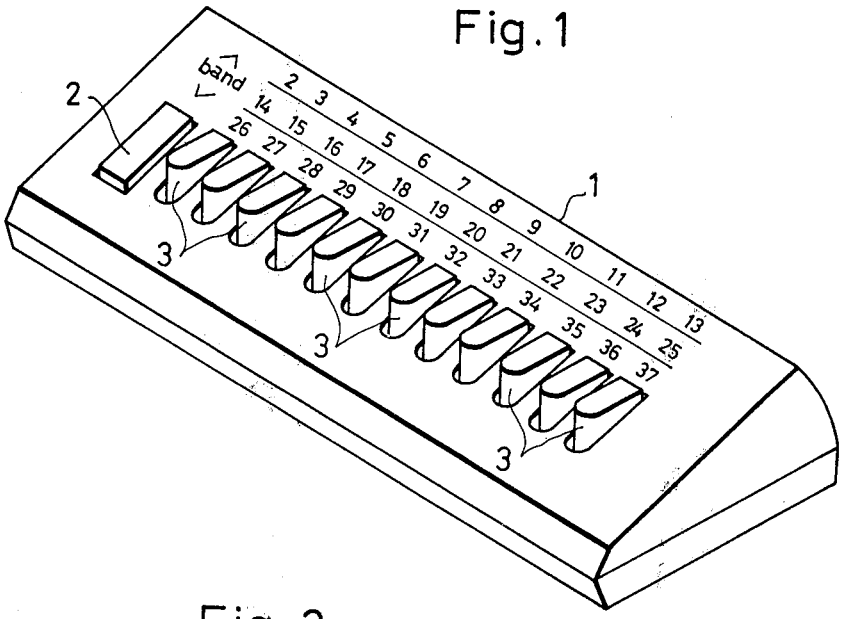
FIG. 1 is a diagram illustrating the outer features of a channel tuner employing push buttons.
Figure 3:
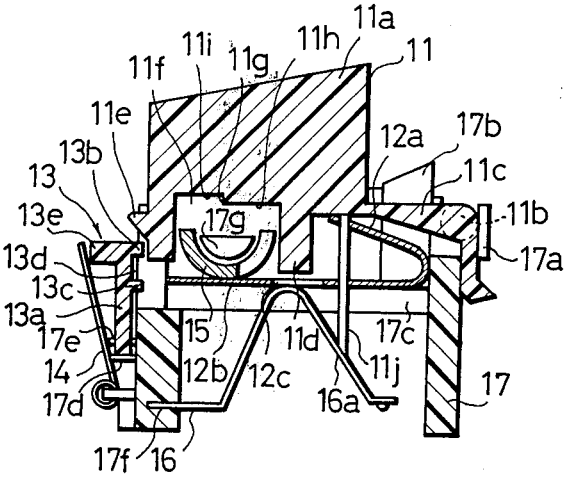
FIG. 3 is a cross-sectional view of the device of FIG. 2.
Figure 2:
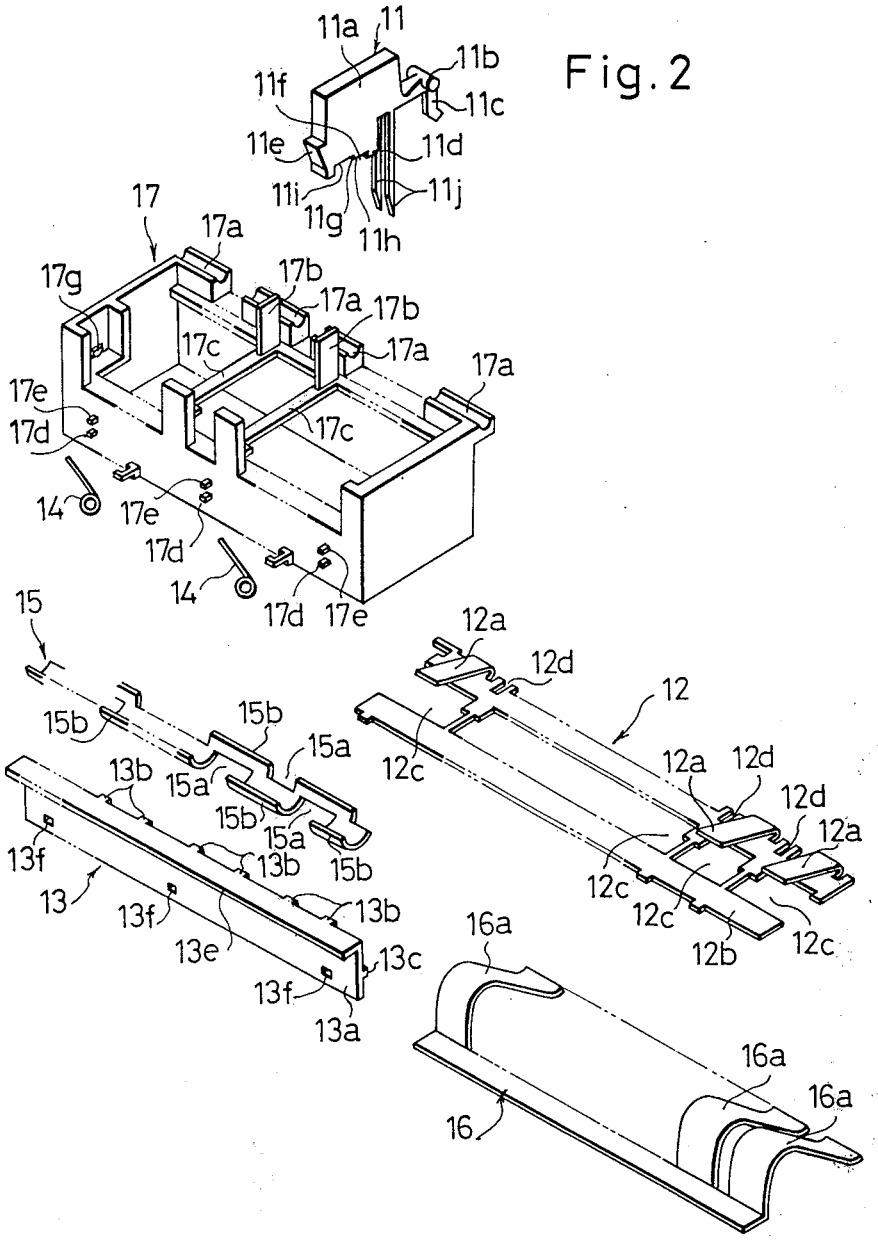
FIG. 2 is a perspective view illustrating, in a disassembled manner, a push button device employing a mechanism for preventing the simultaneous locking according to this invention.

FIG. 2 is a perspective view illustrating, in a disassembled manner, a push button device employing the mechanism for preventing the simultaneous locking according to this invention, and FIG. 3 is a cross-sectional view of the device of FIG. 2.

Reference numeral 11 denotes a push button made of a plastic material, which consists of an operation portion 11*a*, a generally L-shaped member 11*c* extending in an inverted manner from the rear of the operation portion and having a shaft portion 11*b* which serves as a shaft for pivoting the operation portion 11*a*. A contact depressing projection 11*d* extends from the bottom of the operation portion 11*a* to depress a contact, as will be described below, and a cam-engaging projection 11*e* extends from the lower front portion of the operation portion 11*a* and which can depress a cam plate as described below to move it out of engagement with any previously depressed push button when a push button is depressed. A recessed portion 11*f* is formed by the contact depressing projection 11*d*, the bottom of the operation portion 11*a* and the cam engaging projection 11*e*. Further, the bottom of the recessed portion 11*f* is formed with a protruded surface 11*h* and a recessed surface 11*i* defined by a step 11*g* therebetween, and on the bottom of the operation portion 11*a* is formed a projection 11*j* for preventing vibration.

Reference numeral 12 denotes a leaf spring made of metal and having spring elements 12*a* formed in the V-shape, a base plate portion 12*b*, holes 12*c* which are formed in the base plate portion 12*b* and through which the contact depressing projections 11*d* of the push button 11 can penetrate. Notches 12*d* are provided for mounting the leaf spring on the frame, and these notches corresponded to the push buttons. The spring portions 12*a* come onto contact with under side of the L-shaped member 11*c* during depression of the push button 11 to energize the corresponding push button 11 in a direction opposite to the depressing direction.

Reference numeral 13 denotes a generally L-shaped cam plate which is commonly provided for the push buttons. On one side of a base plate 13*a* of the cam plate are formed engagement projections 13*b* which correspond to the push buttons 11, and a continuously formed projection 13*c*. Recessed areas 13*d* are defined between the engagement projections 13*b* and the continuously formed projections 13*c*. At the top portion of the base plate 13*a* on the side opposite the engagement portions 13*b* is formed a continuously protruded rail 13*e* extending orthogonally from the base plate 13*a*. Further, holes 13*f* for mounting the cam plate to the frame 17 are formed in the lower portion at respective ends and the center of the base plate 13*a*. When any push button 11 is depressed, the engagement projection 13*b* lying opposite thereto is depressed by the cam engaging projection 11*e*, whereby the cam plate 13 starts to rotate in the counterclockwise direction. As the push button 11 is further depressed, the cam engaging projection 11*e* moves within the recessed portion 13*d* and is held beneath the engagement projection 13*b*. The push button 11 therefore is locked or latched in a depressed state.

Reference numeral 14 denotes coil springs attached to the frame 17. The coil springs 14 engage the rail 13*e* of the cam plate 13 and urge the cam plate inwardly, thereby maintaining the engagement between the cam engaging projection 11*e* and the engagement projection 13*b* of any latched push button, i.e., to maintain the push button 11 in the depressed state. Reference numeral 15 denotes a cam for preventing the simultaneous locking, which is disposed on the base plate 12*b* of the leaf spring 12 and beneath the recessed portion 11*f* of the push buttons 11, and which will be turned when depressed by the push button. The cam 15 for preventing the simultaneous locking is formed roughly in a semicircular shape in cross section, and has notches 15*a* arranged alternately on each side. The notches 15*a* have a width greater than the width of the push buttons and each straddle a recessed portion 11*f* of a respective push button. Therefore, the cam 15 is able to turn in one direction when it is depressed by a push button, and will turn in the opposite direction if any adjacent push button is depressed. Reference numeral 15*b* denotes projections formed opposite respective notches 15*a*. Further, both ends of the cam 15 are fitted to semi-circular projections of the frame 17, as will be mentioned later, so that the cam 15 can rotate while being guided by the semicircular projections.

Reference numeral 16 denotes a contact having a high resiliency, which consists of a plurality of contact portions 16*a* formed in an inverted V-shape and corresponding to each of the push buttons 11. When a push button 11 is depressed, the contact depressing projection 11*d* depresses the corresponding contact portion 16*a* via the hole 12*c* in the leaf spring 12, to perform the switching operation.

The frame 17 has shaft supports 17*a* for rotatably supporting the shaft portions 11*b* of the push buttons 11, a leaf spring mounting portion consisting of plate-like projections 17*b* which engage with the notches 12*d* of the leaf spring 12 and leaf spring placing portions 17*c*, a cam plate mounting portion which consists of projections 17*d* formed on the side wall of the frame and projections 17*e* that will be inserted in the holes 13*f* of the cam plate 13, and which rotatably supports the cam plate 13. A contact mounting portion 17*f* for fastening the contact 16 is also provided, as well as semicircular projections 17*g* which fit the respective ends of the cam 15 and which guide the rotation of the cam 15.

The function of the mechanism for preventing the simultaneous locking according to the invention will now be described.

Figure 4:
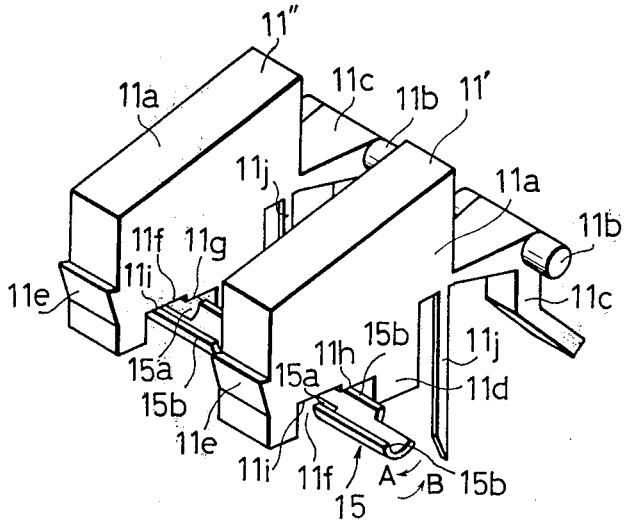
FIG. 4*a* and FIG. 4*b* are diagrams for illustrating the function of the mechanism for preventing the simultaneous locking.
Figure 4:
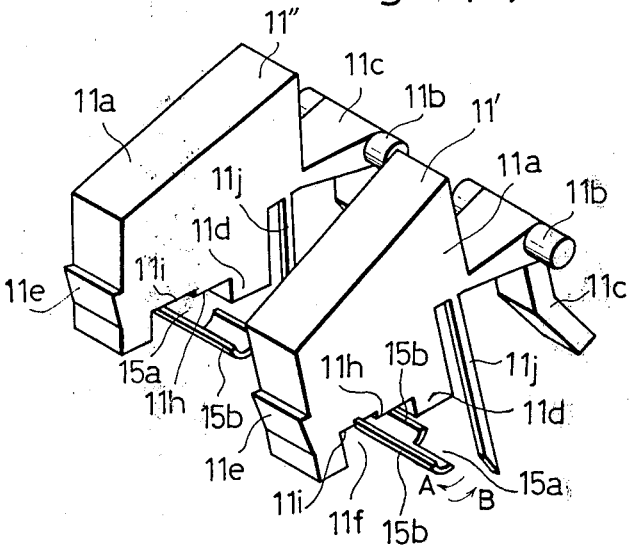

FIG. 4 is a diagram for illustrating the function of the mechanism which prevents the simultaneous locking, in which reference numerals 11' and 11'' denote adjacent push buttons. Here, the members are the same as those of FIG. 2 and are denoted by the same reference numerals, and their details are not illustrated. When the push button 11' fitting with a notch 15*a* formed on the left side of the cam 15 is depressed, the projection 15*b* of the cam 15 is depressed by the protruded surface 11*h* of the push button 11', whereby the cam 15 starts to turn in the clockwise direction as indicated by arrow A, as projection 15*b* starts to descend. As the push button 11' is further depressed, the cam 15 further rotates in the direction of arrow A, and the notch 15*a* bites into the operation block 11*a* (FIG. 4 (*b*)). Depending upon the depressed quantity of the push button 11', the engagement projection 13*b* (FIG. 3) of the cam plate 13 is depressed by the cam engaging projection 11*e*, and the cam plate 13 starts to turn in the counterclockwise direction. When the push button is depressed by a predetermined stroke, the cam engaging projection 11*e* falls in the recess 13*d* and engages with the engagement projection 13*b*. Under this condition, the cam plate 13 is urged inwardly by the coil spring 14 even when the push button 11' is discontinued from being depressed. Therefore, the engagement between the cam engaging projection 11*e* and the engagement projection 13*b* is maintained, and the push button 11' is locked in the depressed state.

If the push button 11'' fitting within the notch 15*a* formed on the right side of the cam 15 is depressed, the cam plate 13 starts to turn in the counterclockwise direction, whereby the push button 11' is disengaged from the cam plate. The push button 11' is allowed to return to the non-depressed position owing to the resilient force of the spring portion 12*a* of the leaf spring 12 and, at the same time, the corresponding contact point 16*a* is allowed to return to the non-depressed position.

Depending upon the depressed quantity of the push button 11'', the projection 15*b* of the cam 15 is depressed by a recessed surface 11*i* of the push button 11'', whereby the cam 15 starts to rotate in the counterclockwise direction as indicated by arrow B, and the level of the projection 15*b* starts to descend. As the push button 11'' is further depressed, the cam 15 further rotates in the direction of arrow B, so that the notch 15*a* bites into the operation block 11*a*.

As the depressed quantity of the push button 11'' reaches a predetermined value, the cam engaging projection 11*e* of the push button 11'' falls in the recessed portion 13*d*, the cam plate 13 is depressed by the coil spring 14, and the cam engaging projection 11*e* comes into engagement with the engagement projection 13*b*. Under this condition, even when the push button 11'' is discontinued from being depressed, the engagement between the cam engaging projection 11*e* and the engagement projection 13*b* is maintained since the cam plate 13 is urged inwardly by the coil spring, and the push button 11'' is held in the depressed state.

In the foregoing were mentioned the cases when only one push button 11 is depressed. Below is mentioned the function for preventing the simultaneous locking when the two neighboring push buttons 11' and 11'' are simultaneously depressed.

Referring to FIG. 4(*a*), the two push buttons 11' and 11'' move downwardly when they are simultaneously depressed. In this case, the projection 15*b* of the cam 15 corresponding to the push button 11' is depressed by the protruded surface 11*h* of the push button 11' and rotates in the direction of arrow A, and comes into contact with the recessed surface 11*i* of the push button 11''. When the push buttons 11' and 11'' are depressed under this condition, the push button 11' works to turn the cam 15 toward the direction of arrow A, whereas the push button 11'' works to turn the cam 15 toward the direction of arrow B. Therefore, the cam 15 cannot turn. Consequently, the depressed quantity of the push buttons 11' and 11'' do not reach such a level that permits the cam engaging projection 11*e* of the push button to engage with the engagement projection 13*b* of the cam plate 13. The push buttons 11′ and 11″ which are discontinued from being depressed return to the non-depressed state, without being locked by a locking mechanism consisting of the cam plate 13, coil spring 14 and the like.

As mentioned above, this invention provides a push button device provided with a function for preventing the simultaneous locking, which is very simply constructed requiring reduced manufacturing cost, which reliably prevents the push buttons from being simultaneously locked, and which can be adapted to channel tuners.

What is claimed is:

1. In a push button switch including a plurality of push buttons, a mechanism for preventing adjacent push buttons from being activated simultaneously, the improvement comprising;

spring means engaging said push buttons for urging them in a direction opposite to the depressing direction;

locking means for locking any one of said push buttons in the depressed state; and means including a cam for preventing simultaneous locking of two adjacent push buttons, said cam having nearly a semicircular shape in cross section and notches at positions corresponding to the positions of said push buttons, said notches having a width greater than the width of said push buttons, and being alternately arrayed on opposite sides of said cam;

wherein said cam is disposed beneath said push buttons and is adapted to be turned when it is depressed by any one of said push buttons and cannot be turned when it is simultaneously depressed by two neighboring push buttons thereby to restrict the quantity of depression by the push buttons.

* * * * *